United States Patent [19]

Wetzel, Jr.

[11] Patent Number: 4,951,750

[45] Date of Patent: Aug. 28, 1990

[54] METHOD AND APPARATUS FOR SINGLE TRIP INJECTION OF FLUID FOR WELL TREATMENT AND FOR GRAVEL PACKING THEREAFTER

[75] Inventor: Rodney J. Wetzel, Jr., Lafayette, La.

[73] Assignee: Baker Hughes Incorporated, Houston, Tex.

[21] Appl. No.: 417,657

[22] Filed: Oct. 5, 1989

[51] Int. Cl.[5] ..... E21B 37/08

[52] U.S. Cl. ..... 166/278; 166/312; 166/51

[58] Field of Search ..... 166/278, 305.1, 312, 166/387, 51, 120, 131

[56] References Cited

U.S. PATENT DOCUMENTS

| | | | |
|---|---|---|---|
| 4,027,732 | 6/1977 | Perkins | 166/312 |
| 4,279,306 | 7/1981 | Weitz | 166/312 |
| 4,431,058 | 2/1984 | Spencer et al. | 166/312 |
| 4,484,625 | 11/1984 | Barbee, Jr. | 166/312 X |
| 4,541,486 | 9/1985 | Wetzel et al. | 166/278 X |
| 4,566,538 | 1/1986 | Peterson | 166/278 |
| 4,570,714 | 2/1986 | Turner et al. | 166/278 |
| 4,733,723 | 3/1988 | Callegari, Sr. | 166/51 |
| 4,815,538 | 3/1989 | Burroughs | 166/312 |

*Primary Examiner*—William P. Neuder

*Attorney, Agent, or Firm*—Hubbard, Thurman, Turner, Tucker

[57] ABSTRACT

A method and apparatus are provided for injection of fluid within a subterranean well for treatment of a production zone within a subterranean well by first initiating flow of treatment fluid into one of uppermost and lowermost portions of the zone and by subsequent continuation of flow of treatment fluid into the other of the uppermost and lowermost portion of the zone. A conduit is assembled which carries a zone isolator, and fluid communicating means having first and second communicating members. The conduit is run into the well until the isolator is set above the zone and the first communicating member is in proximity to the uppermost end of the zone and the second communicating member is in proximity to the lowermost end of the production zone. A first injection flow path is formed for the fluid which extends from the top of the well through the interior of the communicating means and out only the exterior of the second communicating member and into the lowermost end of the zone. A second injection path is thereafter formed for said fluid and extends from the top of the well through the interior only the first communicating member of the communicating means while the fluid is prevented from passing from the interior to the exterior of the second communicating member, the second injection path for the fluid continuing out of the first communicating member and into the other end of the zone. With the zone isolator still in place, gravel packing of the well may be thereafter effected.

28 Claims, 11 Drawing Sheets

METHOD AND APPARATUS FOR SINGLE TRIP INJECTION OF FLUID FOR WELL TREATMENT AND FOR GRAVEL PACKING THEREAFTER

BACKGROUND OF THE INVENTION

1. Field of the Invention

The invention is directed to a method and apparatus for first treating a well production zone, such as, for example, removing lost circulation material temporarily plugging perforations in the well and, thereafter, selectively gravel packing said well.

2. Description of the Prior Art

After a well has been drilled, it is completed by typically running into the well a string of casing which is cemented in place in the well. Thereafter, when the well is cased, perforations are shot through the casing adjacent the selected production zone to permit fluid flow to the top of the well. However, in order to prevent contaminants and to assist in controlling the well to abate a blowout, prior to removal of the equipment which is utilized to perforate the casing, a lost circulation material, which typically may be a solution of carboxymethylcellulose, guar gum, or other lost circulation material which is well known to those skilled in the art, is circulated into the well and spotted across the perforations for temporarily sealing them or, in the case of uncased wells, is spotted across the open production zone. Such lost circulation material is also required to protect the perforations and the porous production zone from the adverse effects of fluids which are required to be injected into the well during and after removal of the perforating equipment to maintain the well in an overbalanced condition for control thereof prior to effective setting of other completion equipment.

Other treatment of wells includes fracturing, acidizing and similar stimulation techniques.

In wells in which gravel packing is required as part of the completion operation to prevent particulate matter contained within the production flow from entering the completion equipment to the top of the well, it is necessary to gravel pack said wells by placing gravel exteriorly of the completion equipment and adjacent the perforations. Such gravel will be sized to prevent particulate matter within the production fluids from passing interiorly through a ported, slotted or screen member of the completion equipment which, itself, is sized to prevent the gravel from passing interiorly into the completion equipment, yet permitting the production fluid to freely pass therethrough into the completion equipment for production to the top of the well.

Prior to such gravel packing operation, the lost circulation material must be removed from the perforations or the open hole production zone. It has been found that prior apparatuses and methods for removal of the lost circulation material have not been entirely satisfactory because they inject the lost circulation material removal fluid in such a manner that it contacts the perforations at their uppermost portion and fluid is induced through such uppermost perforations, thence through the production zone, resulting in lost circulation. Once circulation is lost in such a manner, it is impossible, or extremely difficult, to remove the remaining lost circulation material in the other or lowermost perforations.

The present invention is directed to abating this problem by providing a method and means for removal of the lost circulation material or other treatment material and treatment fluid in a manner that the lost circulation material removal fluid first contacts the lowermost of the perforations before contact with the uppermost perforations. In this manner, the lowermost perforations are cleared and, thereafter, the lost circulation material removal fluid is thereafter permitted to treat the uppermost perforations, from top to bottom. Lost circulation will not occur in such a procedure because any lost circulation material within and behind the perforations which is being removed during the first step, i.e. bottom to top of the lowermost perforations, will fall down into the treated void. Such shifting of the lost circulation material can also be expected to occur when the lost circulation material is treated from top to bottom by contact of the lost circulation treating fluid with the uppermost perforations thereby eliminating, or greatly reducing, the hazards of lost circulation.

The present invention, in essence, provides apparatus and method for removal of a treatment fluid from a production zone by first directing a removal fluid in one direction to contact one end of the production zone and, thereafter by directing the removal fluid in another direction to contact the other end and remainder of the production zone to remove the balance of the treatment fluid or treatment material, i.e., lost circulation material.

The present method and apparatus also has the desired feature of thereafter permitting gravel packing of the production zone without retrieval of the equipment to the top of the well and subsequent tripping into the well with the gravel packing equipment.

SUMMARY OF THE INVENTION

Figure 1A:
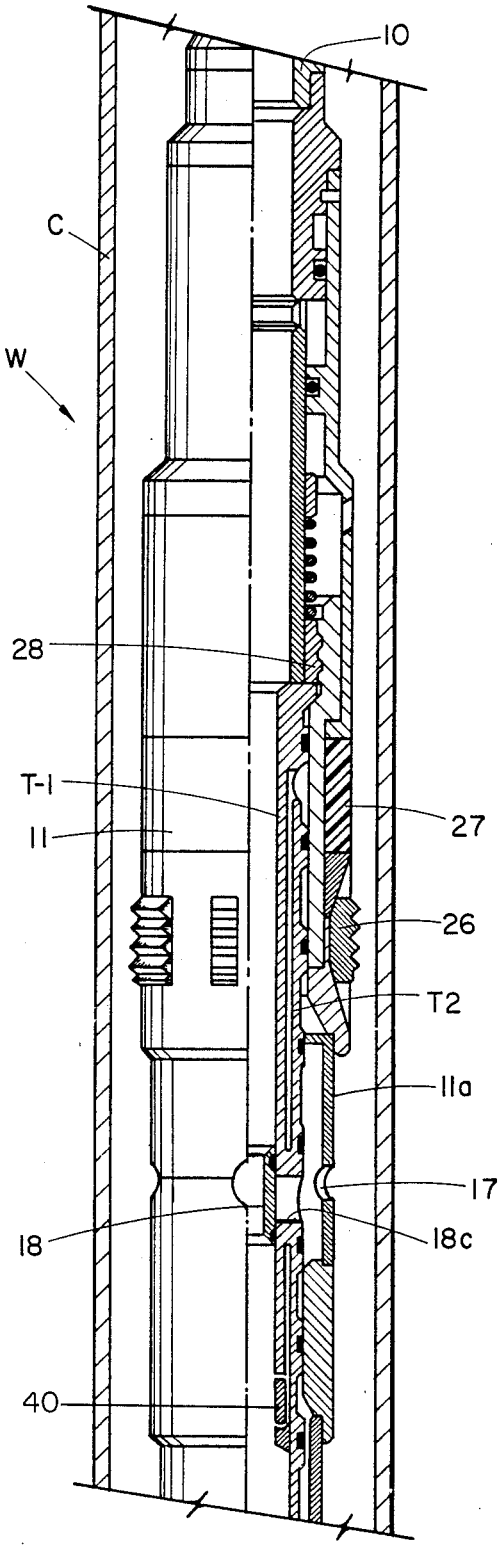
FIGS. 1A and 1B together comprise a longitudinal sectional schematic illustration of the apparatus of the present invention run into a subterranean well.

The present invention provides a method and apparatus for injection of fluid within a subterranean well for removal of lost circulation material or other treatment material and/or fluid which has been deposited within perforations through a first perforated well conduit section traversing a production zone, or, in uncased wells, across or within the production zone formation by first initiating removal of the material either upwardly or downwardly from the lowermost or uppermost portion of the section and by subsequent continuation of removal of the material in the other direction from the other of the uppermost and lowermost portion of the section.

In a preferred form, the method comprises the steps of assembling a second conduit which carries a zone isolator and fluid communicating means comprising first and second communicating members. The second conduit is run into the well until the isolator is positioned above the production zone with the first communicating member substantially adjacent to the perforations and the second communicating member being in proximity to the lowermost end of the perforations. The isolator, or well packer, is sealingly secured within and against the first well conduit above the zone. A first injection path is formed for the lost circulation material removal fluid which extends from the top of the well through the interior of the communicating means and out only the exterior of the second communicating member and into the lowermost of the perforations for contact with and removal of the lost circulation material. A second injection path is formed for the lost circulation removal material fluid which extends from the top of the well through the interior of only the first communicating member of the communicating means while preventing the fluid from passing from the interior to the exterior of the second communicating member, the second injection path for the fluid continuing out of the first communicating member and into the other of the perforations for contact with and removal of the remainder of the lost circulation material. After removal of the lost circulation material, and with the isolator or well packer continuing to be sealingly secured within and against the first well conduit above the production zone, a gravel pack fluid flow path is formed which extends from the surface downhole through the interior of the isolator, around the exterior of the communicating means, and a return fluid flow path for the gravel pack fluid is established through the interior of the communicating means and backup hole to the top of the well. Gravel is mixed with a gravel pack fluid and the mixture is flowed in the gravel pack fluid flow path until the gravel is deposited in the well below the isolator means and exterior of the communicating means with the gravel pack fluid returning through the interior of the communicating means within the return fluid flow path up hole to the top of the well. With the isolator, or well packer still in sealingly engaged position, as described above, a production flow path is formed from the production zone, through the perforations, through the deposited gravel, through the communicating means and up hole to the top of the well. Thus, the lost circulation material removal procedure as well as the gravel packing of the well each may be accomplished all in one trip of a work string into the well.

DESCRIPTION OF THE PREFERRED EMBODIMENTS

Figure 1B:
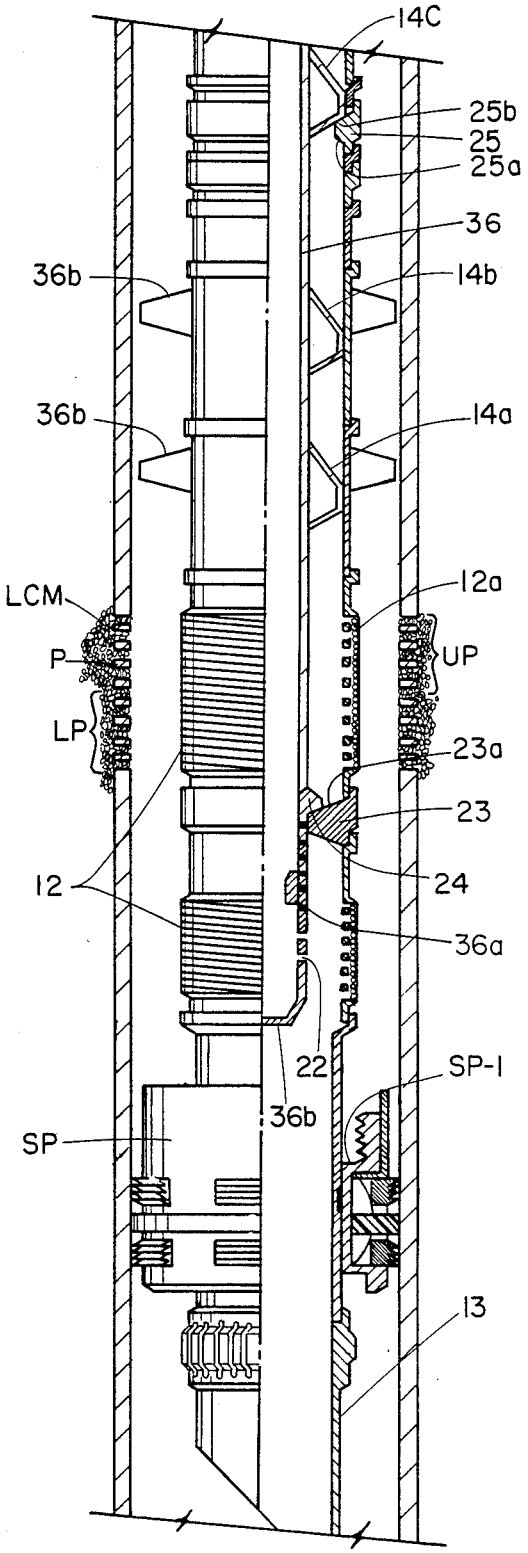

With reference to the drawings, and, particularly, FIGS. 1A and 1B, there is shown in position within a longitudinally extending well W a first perforated well conduit section C extending from the top of the well (not shown) through a production zone PZ with a longitudinally extending section of circumferentially implaced perforations P shot therethrough for communication to production within the production zone PZ. The perforations P are, for purposes of the present method, provided in an uppermost portion of perforations UP and a lowermost portion of perforations LP, the line between each of the portions of the perforations UP, LP, being, of course, indefinite, and being determined by the amount of treatment and positions of the apparatus for treatment for removal of the lost circulation material, as hereinafter provided.

After the perforations P have been shot through the well conduit section C, the perforating equipment (not shown) is withdrawn from the well. The perforating equipment may either be wireline, or conveyed into the well on tubing, the particular method of perforating the well not being a part of the present invention. Prior to withdrawal of the perforating equipment, the perforations are temporarily plugged by means of circulation into the well of a lost circulation material, such as a fluid containing carboxymethylcellulose, or the like, and such material LCM is temporarily implaced within the perforations to block fluid communication there across. Thereafter, when it is desired to continue completion of the well, such as by effecting gravel packing, or other completion operation, a second conduit 10, which may be a tubular work string, production tubing, or a wireline is introduced within the interior of the well W and the well conduit section C, concentrically. The second conduit 10 carries at its lowermost end a zone isolator 11, tail pipe section 11*a* therebelow and fluid communicating means 12 with fluid communicating members 12*a* and 12*b*.

When the preferred embodiment of the invention, as shown in the drawings, is utilized, the fluid communicating means 12 will include the two screens 12*a* and 12*b* and the upper screen 12*a* will be in proximity to the uppermost end of the perforations P by being positioned across the upper portion UP of the perforations P. However, as used herein an din the claims it is anticipated that alternate embodiments or methods of this invention could be utilized which would not require the use of the upper screen member 12*a*. In such instances, it will be appreciated that the fluid communicating means will then include as the second communicating member the lower screen 12*b* and another flow passage or port such as cross-over port 18*c* and its interrelated fluid flow passages, as the first fluid communicating member. In such embodiments or methods, the port 18*c* will be positioned in proximity to the uppermost end of the perforations by actually being placed somewhat above such perforations P, as shown in FIGS. 1A, 1B.

At the lowermost end of the tail pipe section 11*a* and below the fluid communicating means 12 is a sump latching and securing device 13 which is stabbed through the hollow interior SP-1 of a sump packer mechanism SP which serves to locate the bottom of the well W below the production zone PZ.

As the equipment described is run into the well on the second conduit 10, the lowermost end of the tail pipe 11*a* is stabbed through the interior SP-1 of the sump packer SP such that the sump latching and securing device 13 collet mechanism will flex outwardly upon passage through the lowermost end of the sump packer SP to prevent the tool from passing upwardly until the latching mechanism is activated, in a known manner, to permit retrieval of the tail pipe section 11*a* and zone isolator 11 from the position as shown in FIGS. 1A and 1B.

The zone isolator 11, tail pipe section 11*a*, fluid communication means 12, together with the securing device 13, may be run into the well on the second conduit 10 which may be either an electric line or wireline. If the conduit 10 is such an electric or wireline, the zone isolator 11 will be set using such line in a known fashion, and the line will be retrieved to the top of the well. Thereafter, a work string or production string will be run into the well and secured in a known manner to the zone isolator 11.

The zone isolator 11, or well packer, may be one of a number of commercially available devices, its purposes being to sealingly isolate the production zone PZ from the interior of the well thereabove, it being sufficient that it provide a sealing means, such as a section of an elastomeric material 27 and means, such as slips 26, for gripping and securing the isolator 11 in position against longitudinal and/or rotational movement within the well above the zone PZ. As shown in the preferred embodiment, the isolator 11 is a well packer, commonly referred to as the "SC-1" GRAVEL PACK PACKER, manufactured and sold by the Baker Sand Control Division, Baker Hughes Production Tools, Inc., Houston, Tex. Such packer is hydraulically activated to the set position (FIG. 3A) by means of a ball 20 which is pumped or gravitated to seating position on a setting sleeve 19 which is shearably secured to an inner mandrel member 36 longitudinally positioned within the tail pipe section 11*a*.

Figure 2A:
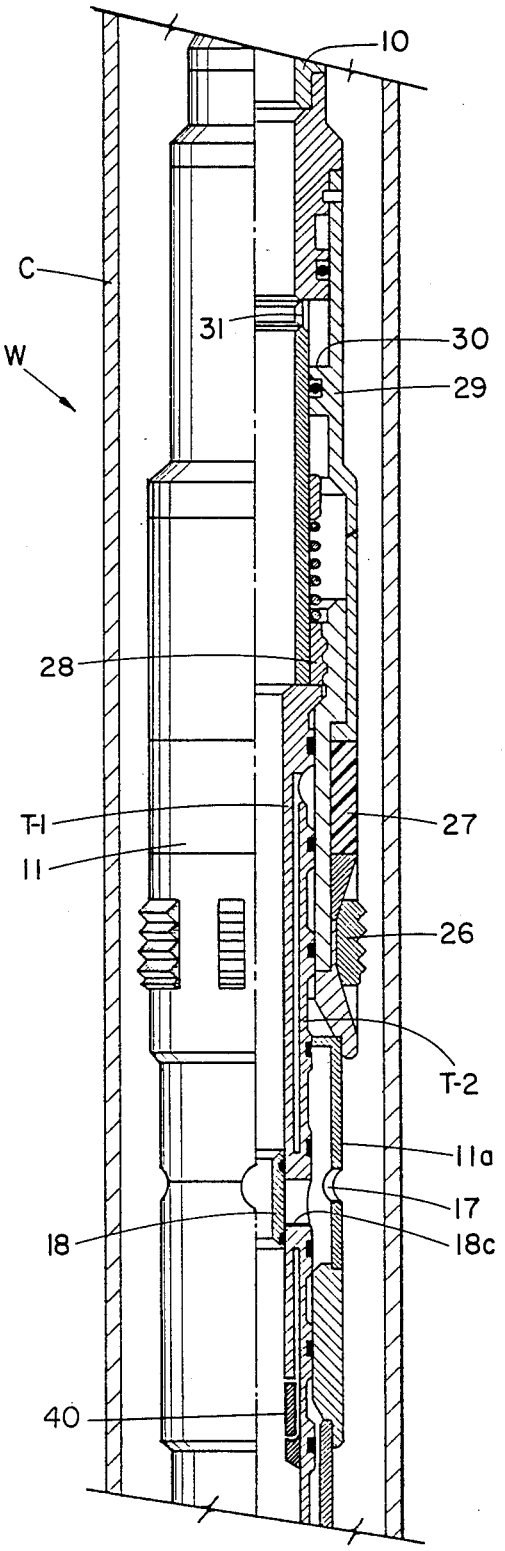
FIGS. 2A and 2B together are a partial longitudinal sectional schematic view, similar to that of FIGS. 1A and 1B, showing hydraulic activation of the isolation means.
Figure 2B:
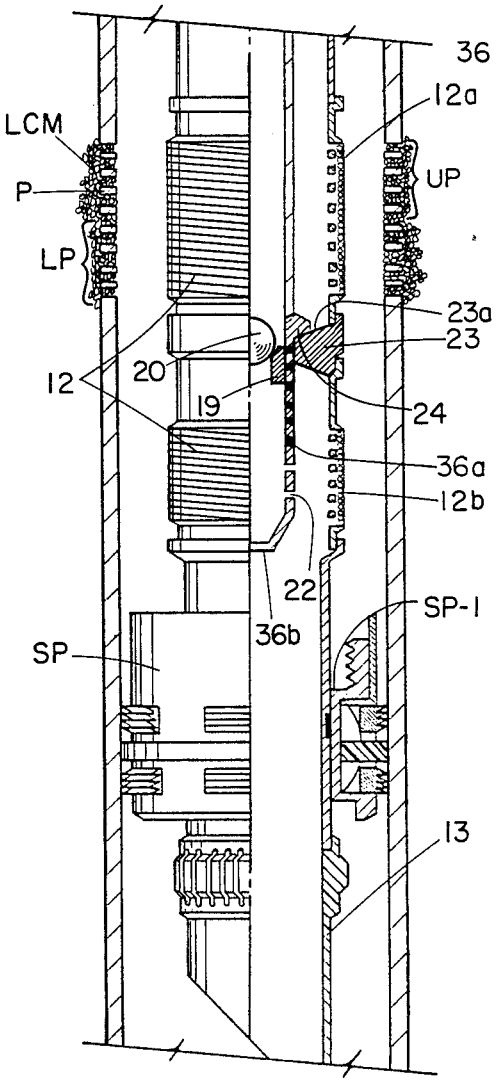
Figure 3A:
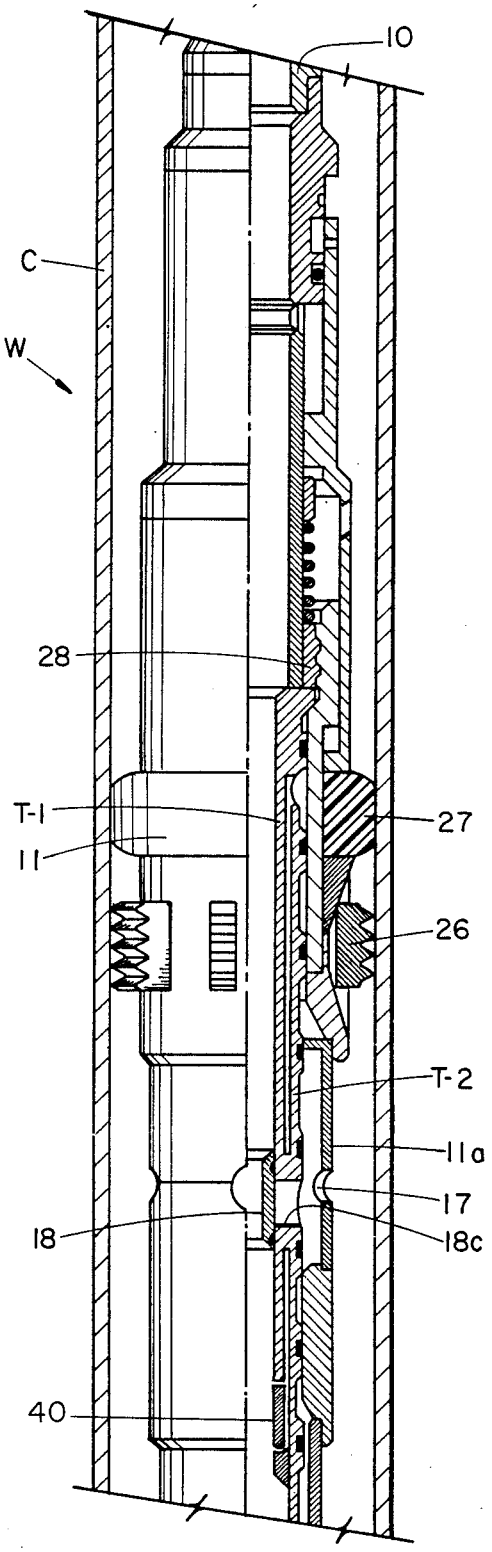
FIGS. 3A and 3B are views similar to that of FIGS. 1A and 1B showing the isolation means sealingly secured within the well against the first well conduit.
Figure 3B:
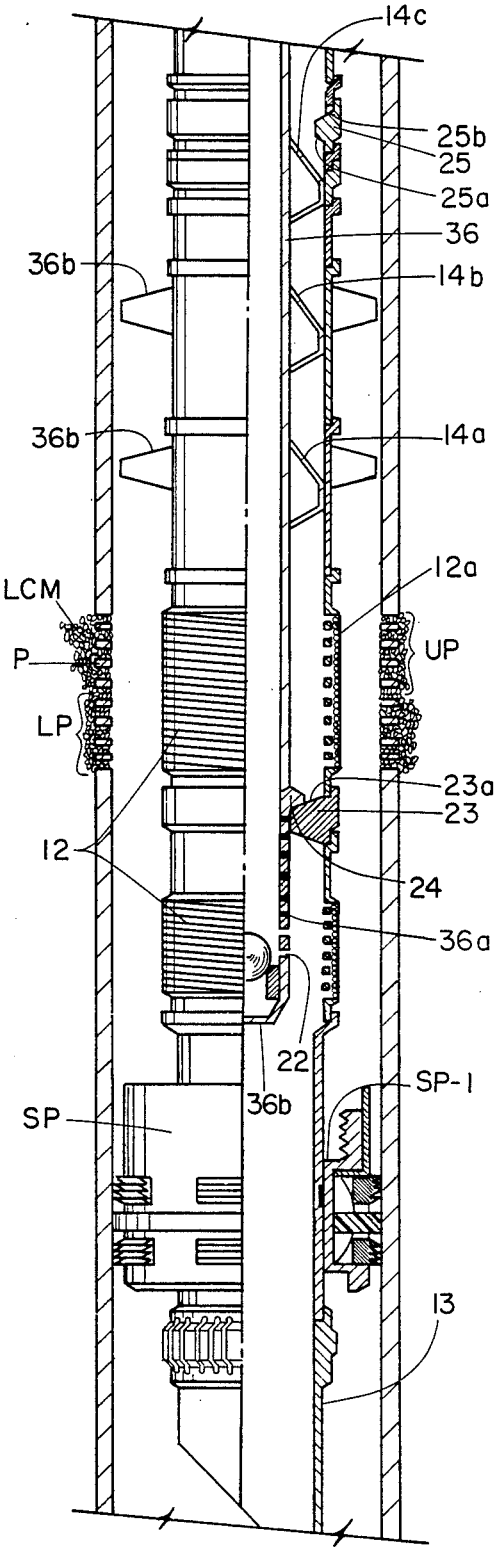

Now with reference to FIGS. 2A and 2B, once the ball 20 is sealingly positioned upon the ball seat 19, fluid pressure is increased within the conduit 10 such that fluid may enter a piston chamber 30 through a port 31 in the setting mechanism portion of the zone isolator 11 to act upon a piston setting sleeve 29 to actuate the slips 26 outwardly and into gripping engagement with the well conduit C and move the packing mechanism seal 27 for sealing securement along the interior wall of the well conduit section C. Now, hydraulic pressure is increased over the amount which is predeterminedly calculated and required to set the isolator 11 such that the ball seat 19 is shearingly disengaged within the interior of the inner mandrel 36 and it drops, together with the ball 20, to the lowermost end of the inner mandrel 36, as shown in FIG. 3B.

The tail pipe section 11*a* has an inwardly extending indicator means 25 having an internal diameter less than the internal diameter of the tail pipe section 11*a* with an upwardly facing indicating surface 25*b* and a lower facing indicator surface 25*a* thereon.

The inner mandrel 36 has a series of longitudinally spaced outwardly beveled flexible indicating means, 14*a*, 14*b* and 14*c* which, when they contact the respective faces 25*a*, 25*b* of the locating means 25 cause resistance to longitudinal movement of the conduit 10, thereby indicating at the top of the well that the mandrel 36 is at a predetermined and known position within the tail pipe section 11*a* for performing various operations in which a desired flow path is selected according to the position of the inner mandrel 36 relative to the tail pipe section 11*a* and isolator 11.

Figure 4A:
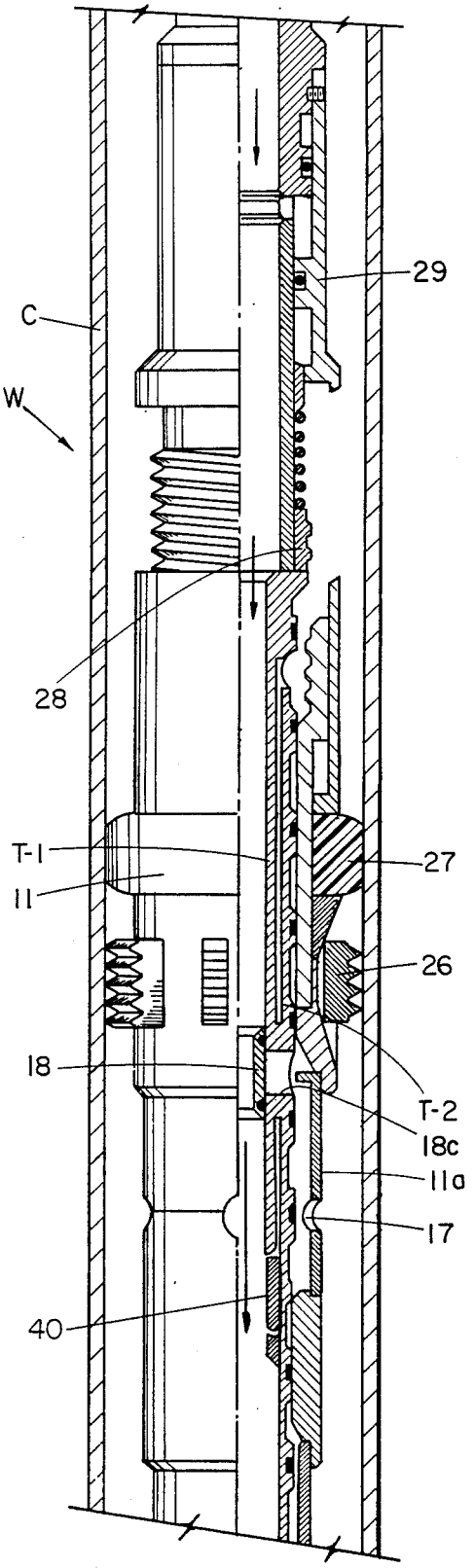
FIGS. 4A and 4B are views similar to the previous views showing the apparatus of the present invention in position for circulating fluid for removal of the lost circulation material or other treatment material or fluid for first contact with the lowermost portions of the perforations through the second of the communicating members.
Figure 4B:
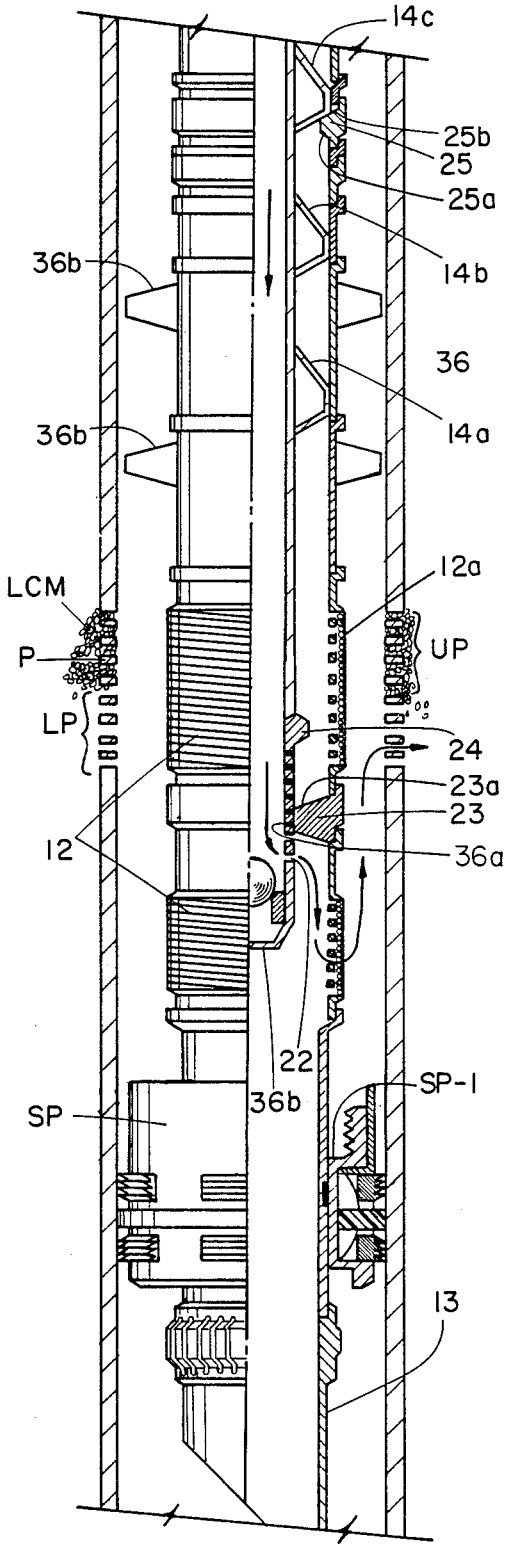
Figure 7A:
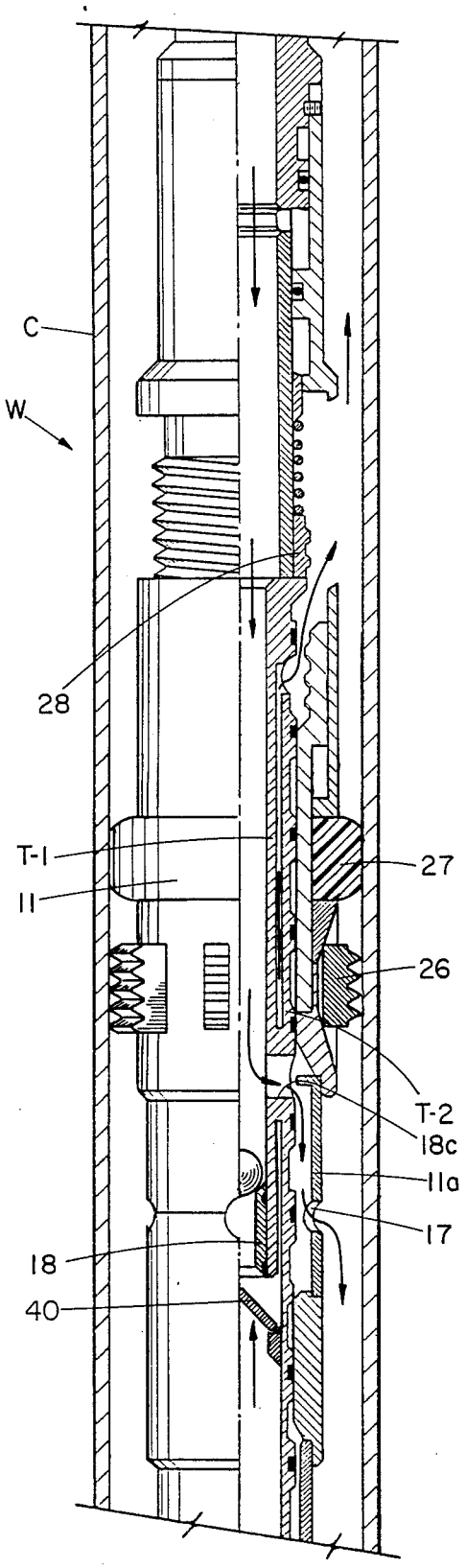
FIGS. 7A and 7B show the cross-over tool positioned to permit lost circulation treating fluid to circulate across the perforations, thence interiorly of the apparatus through the lowermost communicating member.
Figure 7B:
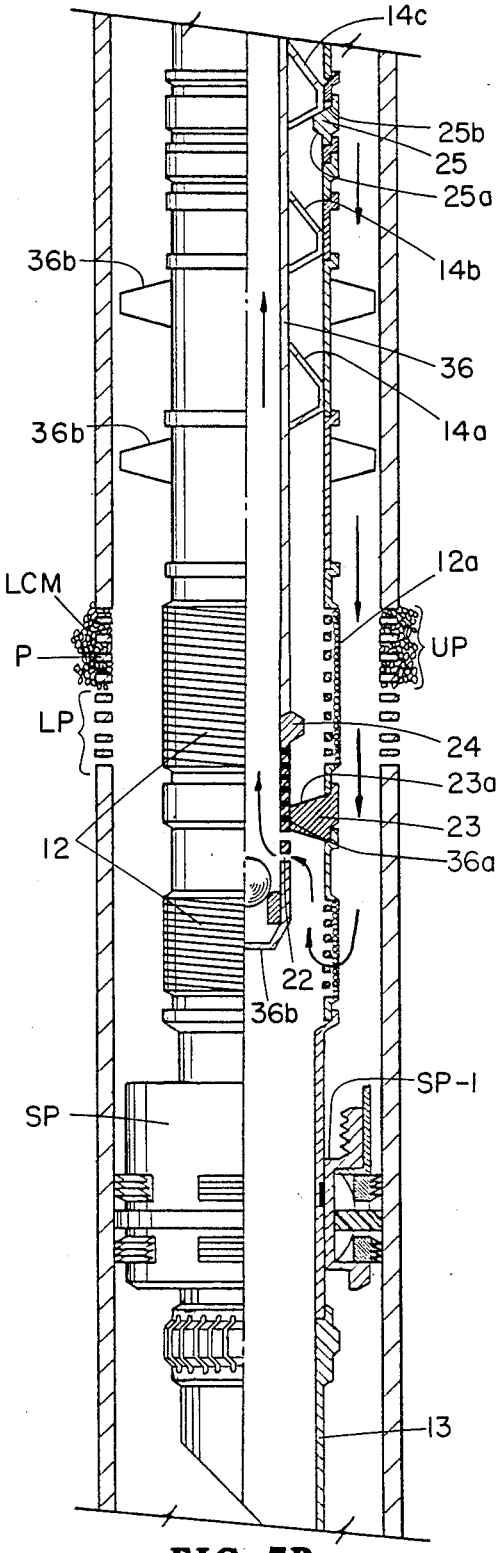
Figure 10A:
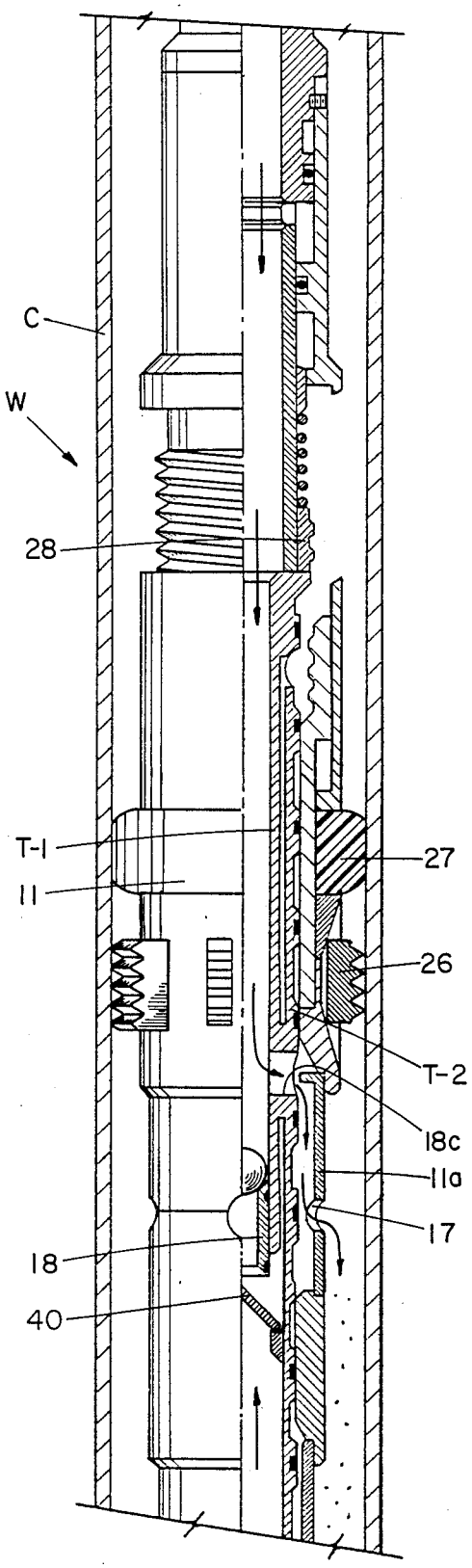
FIGS. 10A and 10B are views similar to that of FIGS. 7A and 7B, but showing the apparatus in position to introduce the gravel packing fluid and gravel into the well for placement exterior of the communicating means adjacent to the perforations.
Figure 10B:
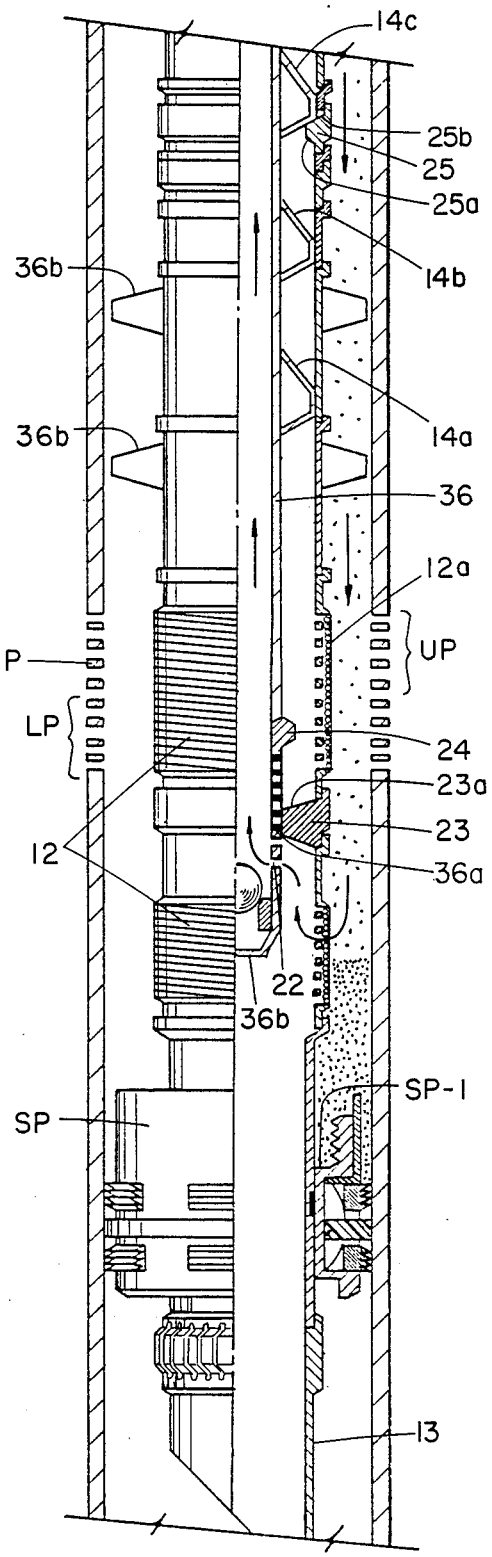

For example, as shown in FIG. 4B, the uppermost indicator 14*c* is positioned on the upper face 25*b* of the locator means 25 thereby indicating to the operator at the top of the well that the apparatus is in the position for initial treatment of the lowermost perforations LP, and is also in the position shown in FIG. 7B, during treatment of the well for removal of the lost circulation material, or during the gravel packing operation (FIG. 10B). When the conduit 10 is manipulated such that the tail pipe 11*a* is moved upwardly from, for example, the position shown in FIG. 7B, to the position shown in FIG. 8B, and light set down weight has been applied, the middle indicator 14*b* will contact the uppermost locating face 25*b* of the locating means 25 to indicate to the operator that the apparatus is in the position shown in, for example FIG. 8B. The flow path through the apparatus and the well would then be as shown by the arrows in FIGS. 8A and 8B.

Figure 9A:
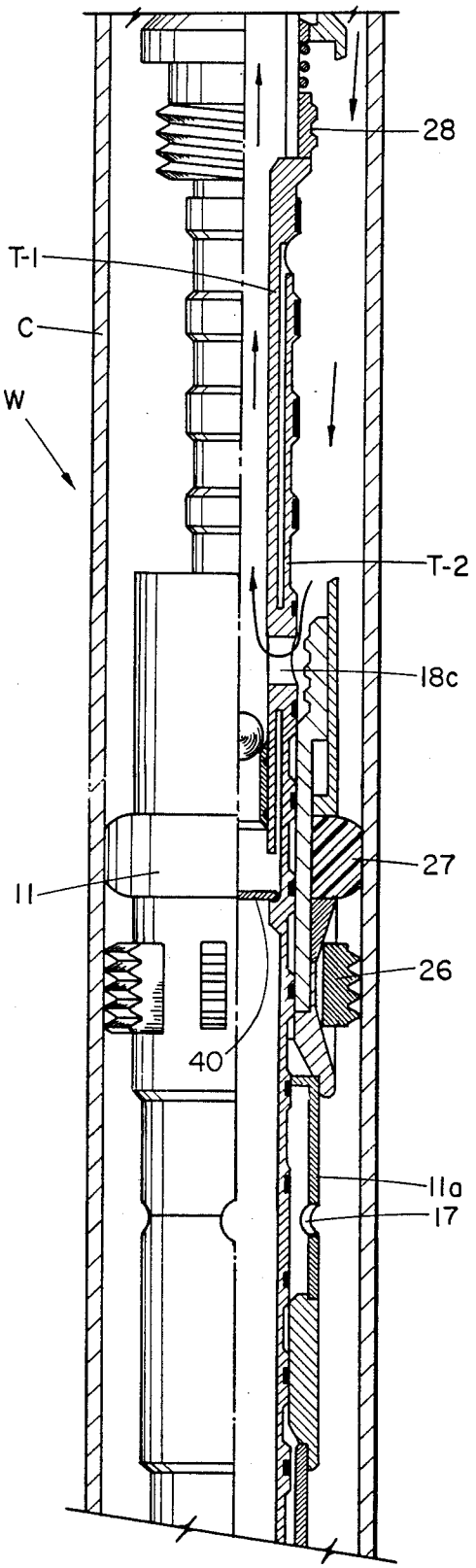
FIGS. 9A and 9B are longitudinal views in schematic showing the interior of the apparatus completely lifted such that fluid may be circulated above the isolator means but not therebelow, for cleaning or washing of the well thereabove prior to or after the gravel packing procedure.
Figure 9B:
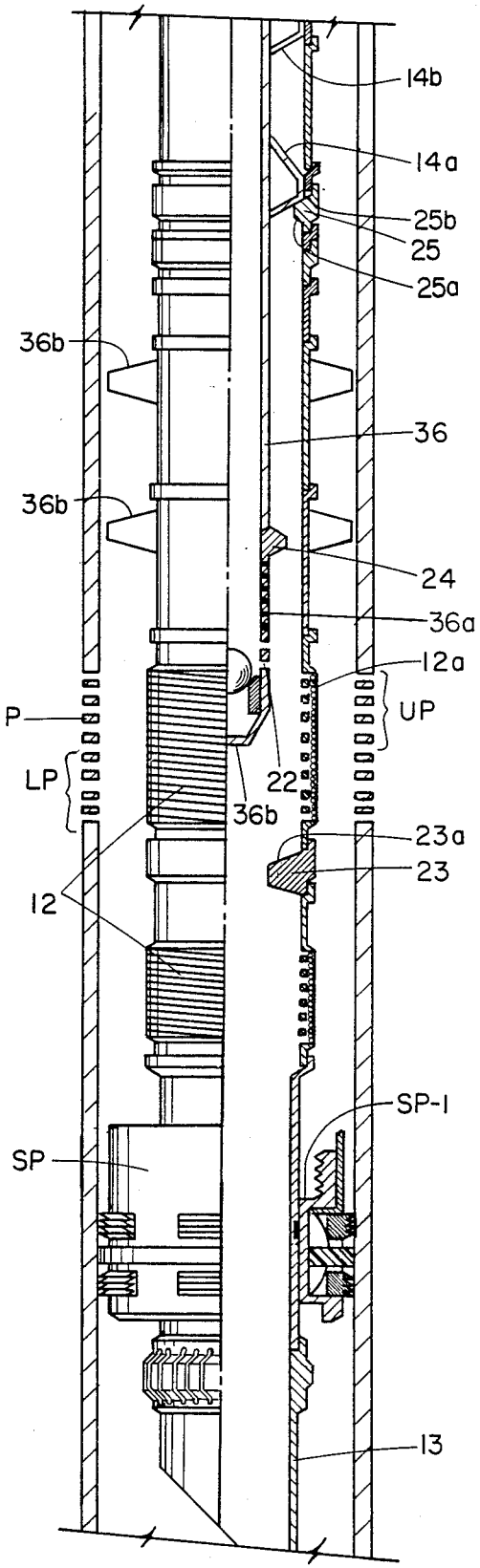

When the apparatus is moved to its uppermost position by means of manipulation of the conduit 10 to move the tail pipe section 11*a* such that the lowermost indicator 14*a* may be positioned on the upper face 25*b* of a locator means 25, the apparatus is in the position shown in FIG. 9B to prevent circulation of fluid interiorly through the isolator 11, but through the annular area above the isolator 11 and into the interior of the conduit 10 for washing out of the interior of the well W above the isolator 11. The flow path for fluid would be as shown in FIGS. 9A and 9B with the apparatus in this position.

As the conduit 10 is longitudinally manipulated, the tail pipe section 11*a* will move correspondingly within the well W and the indicators 14*a*, 14*b* and 14*c* will contact and pass the lower face 25*a* of the locating means 25, indicating to the operator that only slight continued pickup of the tubing conduit 10 is necessary and that light set down may be implaced until the selected indicator, 14*a*, 14*b*, or 14*c* contacts the upper face 25*b* of the locating means 25 to resist further downward movement of the conduit 10 to indicate to the operator that the selected positioning of the tail pipe 11*a* and the apparatus are at the desired position within the well for the selected operation.

The inner mandrel 36 also has an outwardly extending locating mechanism 24 placed circumferentially around the exterior of the mandrel 36 and somewhat below the lowermost indicator means 14*a* for contact with a companion upwardly facing shoulder 23*a* of a seal bore receptacle 23. Upon engagement of the shoulders 24, 23*a* the inner mandrel 36 will be prevented from further downward longitudinal movement within the tail pipe section 11*a*, and the operator will know that the inner mandrel 36 is in position whereby a set of chevron or other configured sealed members 36*a* placed circumferentially around the exterior of the inner mandrel 36 below the member 24 will be within a receptacle for sealing securement within the interior of the seal bore receptacle 23, thereby isolating the first and second fluid communication members 12*a* and 12*b* relative to the interior of the inner mandrel 36.

The inner mandrel 36 has below the seal section 36*a* a series of ports 22 positioned just above its lowermost sealed end 36*b*. It is through these ports 22 that fluid will flow in a manner hereinafter described. It should be noted that the ports 22 are positioned slightly above the position of the isolator 11 setting ball and seat 20, 19 when same are shearingly removed from the interior of the inner mandrel 36 after the setting of the isolator 11, as described above.

In order to assure that the tail pipe section 11*a* is concentrically positioned within the well conduit C and within the approximate center thereof, a series of centralizers 36*b* are selectively longitudinally positioned around the exterior of the tail pipe section 11*a*.

Figure 6:
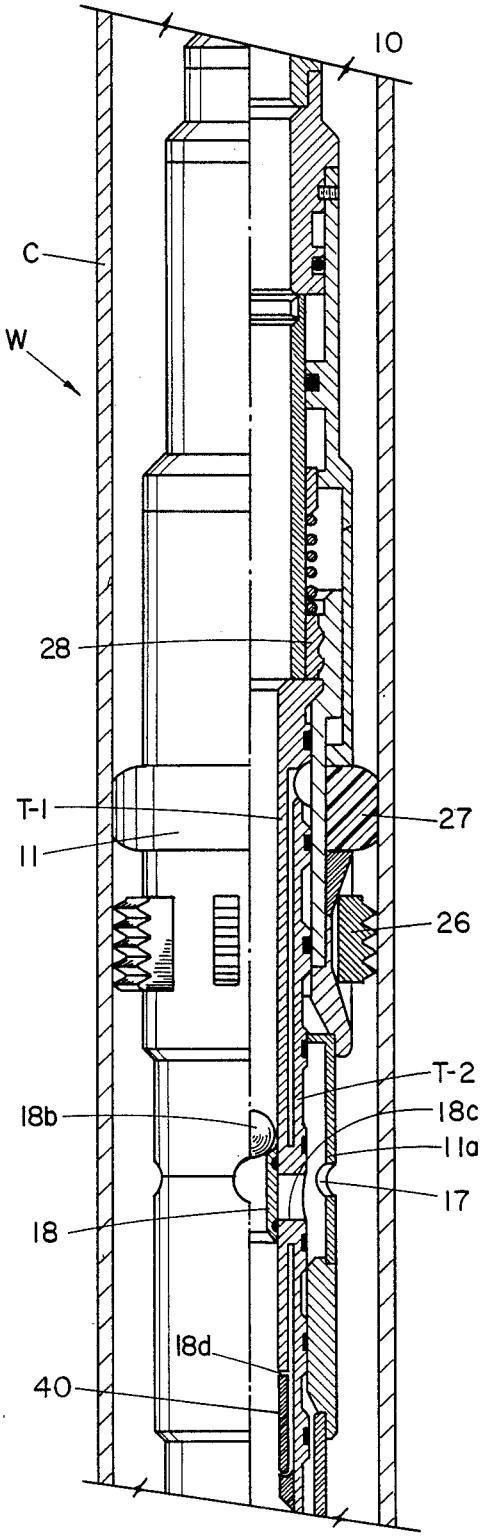
FIG. 6 is a partial longitudinal sectional view showing activation of a preferred cross-over means to a position for initiating fluid flow into the annular area between the tool and the casing below the isolator means and for re-entry through the cross-over tool below the lowermost of the communicating members.

In the preferred mechanism as shown in the drawings, a cross-over tool assembly includes the inner mandrel 36 having a long longitudinally extending set of seals 36*a* for sealing within the interior of the isolator 11 as the conduit 10 is manipulated to position for providing the various fluid flow paths as hereinafter described. The cross-over tool is defined by concentrically disposed tubing members T-1 and T-2 which extend downwardly out of the interior of the isolator 11 and within the uppermost end of the tail pipe section 11*a*. A seal seat 18 is provided thereon for receipt of a ball member 18*b* (FIG. 6) which is pumped or gravitated down the interior of the conduit 10 through the isolator 11 to seating position on the seat 18 when it is desired to shift the seat, which is shearingly secured around the internal diameter of the innermost of the concentric members T-1, T-2 of the cross-over assembly to shift the seat downwardly to permit opening of a flow passage port 18*c* therethrough. The ball 18*b* is shown on its seat 18 in FIG. 6 for increase of hydraulic pressure activation to shift the sleeve. Prior to placing the ball 18*b* on the seat 18, the lowermost end 18*d* of the cross-over is open to the interior of the inner mandrel 36.

To manipulate the cross-over assembly including the inner mandrel 36 to establish the flow path shown in the respective figures, the conduit 10 is manipulated after the isolator 11 is hydraulically set. Such manipulation preferably is in the form of rotational movement in a first direction to permit a floating securing nut 28 to become unthreaded relative to the housing of the isolator 11. Once the threads relative to the nut 28 and housing of the isolator 11 are broken, the conduit 10 may be picked up to separate a setting sleeve 29 and permit fluid flow into the annulus between the second conduit 10 and the well conduit C above the isolator 11, as shown in, for example, FIG. 7A.

Figure 8A:
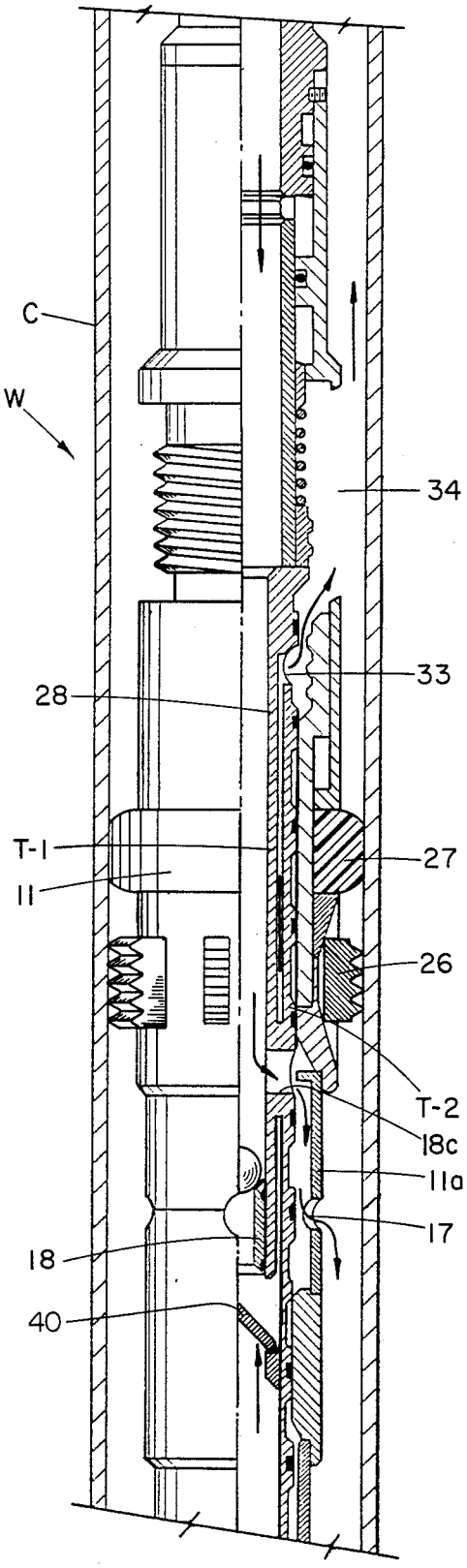
FIGS. 8A and 8B are longitudinal schematic illustrations, similar to the previous views, showing a preferred cross-over tool positioned to permit the lost circulation removal fluid to contact the uppermost of the perforations and thence enter the interior of the apparatus through at least the uppermost or first of the communicating members, then to the top of the well above the isolator means through the annulus between the casing and the well conduit concentrically disposed therein.
Figure 8B:
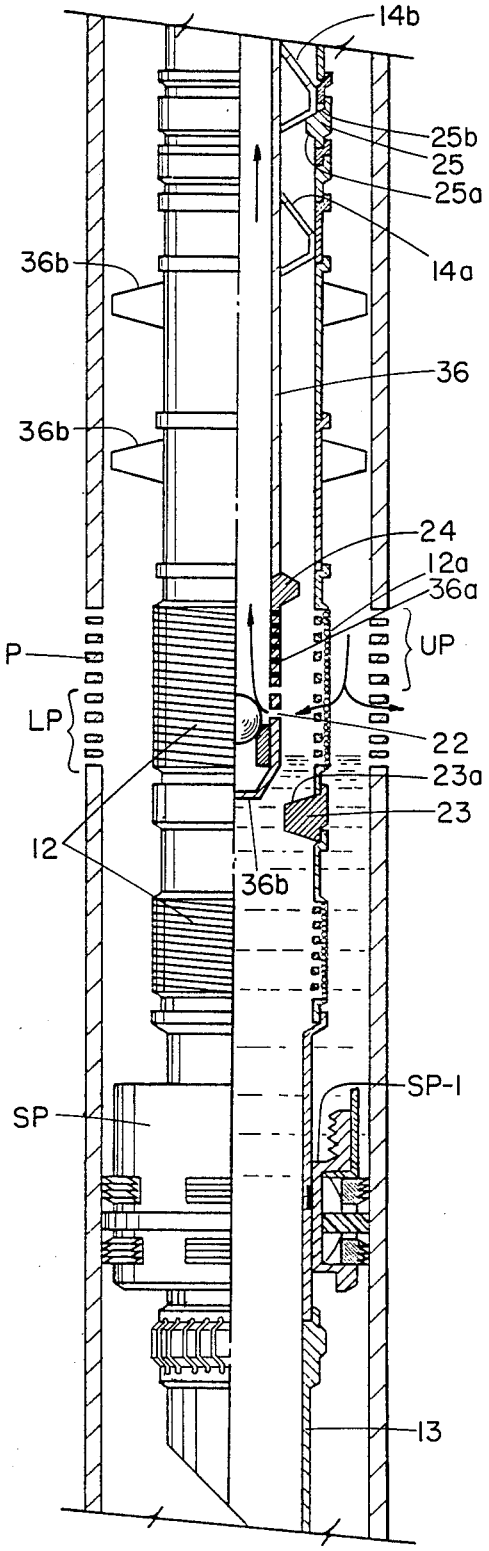

As shown in FIGS. 8A and 8B, once the cross-over tool is in the position as shown, fluid may flow upwardly and out of the uppermost end of the cross-over tool through an annular area between the concentric members T-1, T-2 of the cross-over tool at opening 33, thence in the annular area 34 above the isolator 11 defined between the interior of the conduit C and the exterior of the conduit 10 for return to the top of the well.

A flapper valve mechanism 40 is shown in open position (FIG. 7A). The flapper mechanism 40 is spring biased closed, but is urged open by upward flow of fluid, as shown by the arrows in FIG. 7A.

OPERATION

When the apparatus is positioned within the well W as shown in FIGS. 1A, 1B, the isolator 11 is above the production zone PZ and the fluid communicating means 12 has its uppermost member 12*a* in proximity to uppermost end of the perforations P, with the lowermost fluid communicating means 12*b* positioned somewhat below and in proximity to the lowermost portions LP of the perforations P. The seals 36*a* on the exterior of the inner mandrel 36 are sealingly received within the seal receptacle 23.

As shown in FIG. 2B the ball 20 for the setting of the hydraulic isolator 11 is gravitated or pumped down the interior of the conduit 10 and is sealingly positioned upon the ball seat or sleeve 19. Fluid pressure within the interior of the conduit 10 is increased and passes through the port 31 into the piston chamber 30 to urge the setting sleeve 29 down relative to the seal mechanism 27 and slip assembly 26 to secure the slips into gripping engagement along the interior of the conduit C, as shown in FIG. 3A.

Now, the cross-over tool and conduit 10 are disengaged from the interior of the packing element 11 by rotationally manipulating the conduit 10 to free the nut 28 from threaded engagement within the interior of the uppermost portion of the isolator 11. Upon disengagement of the nut 28, the conduit 10 is picked up until the uppermost indicator 14*c* passes above the indicator means 25. Thereafter, set down weight is applied, slightly, until the lowermost face of the upper indicator 14*c* rests upon the upper face 25*b* of the locator 25 and the operator at the top of the well thus receives an indication of weight resistance relative to movement of the conduit 10, thus indicating that the apparatus is in the position shown in FIGS. 4A–4B, with the seals 36*a* still positioned within the seal receptacle 23 to separate the fluid communicating members 12*a*, 12*b* from one another relative to the interior of the inner mandrel 36. Now, as shown in FIGS. 4A, 4B, lost circulation material removal fluid is introduced through the conduit 10 and passes through the apparatus as shown by the arrows. The fluid passes through the screen 12*b* and then into the lower portion LP of the perforations P.

Now, a valve (not shown) at the top of the well may close the tubing casing annulus defined between the interior of the perforated well conduit section C and the exterior of the concentrically disposed second conduit 10 may be manipulated to closed position, thus preventing fluid returns to the top of the well through this annular area above the zone isolator 11. Now, the fluid containing lost circulation removal chemical, such as a solution of 5% active hydrochloric acid or an unsaturated viscous brine, or the like, may continue to be introduced through the interior of the conduit 10 for passage through the inner mandrel 36 and outwardly thereof through the ports 22, then from the interior of the tail pipe 11*a* to the exterior thereof through the lowermost fluid communicating means 12*b*.

As the annular area above the sump packer SP fills with such lost circulation material removing fluid, such fluid will begin to contact the lowermost portions of the perforations LP and remove the lost circulation material LCM therethrough.

Figure 5A:
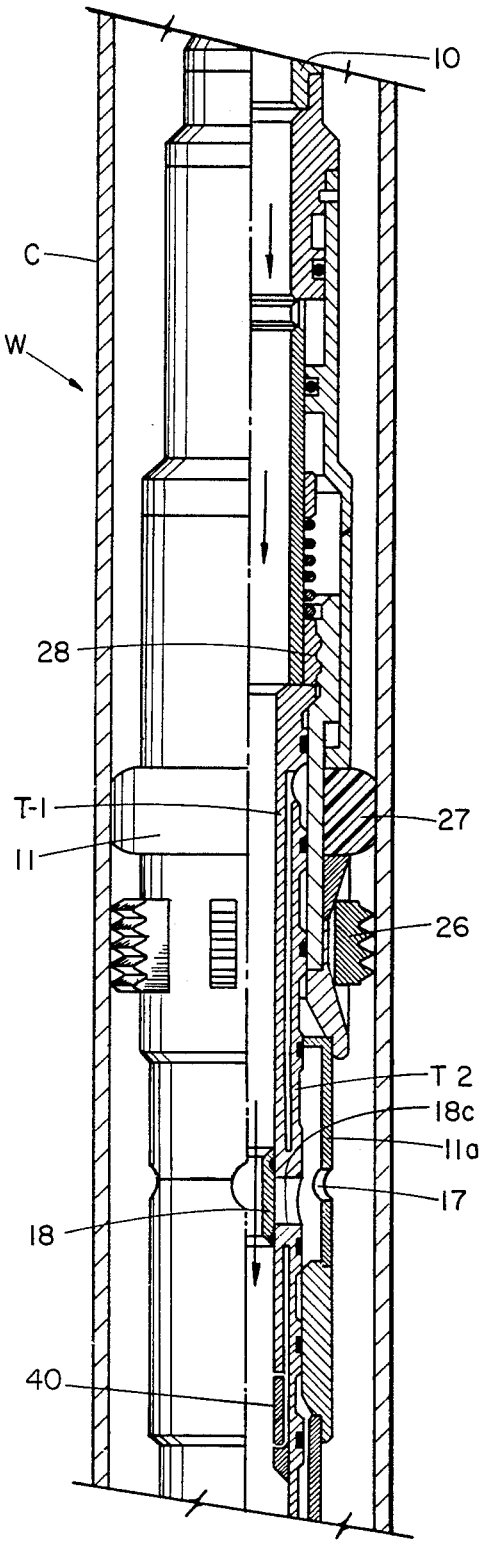
FIGS. 5A and 5B are views, in partial longitudinal section, similar to that of FIGS. 4A and 4B, with the apparatus positioned for squeezing of, for example, the lost circulation material removal fluid into the lowermost of the perforations.
Figure 5B:
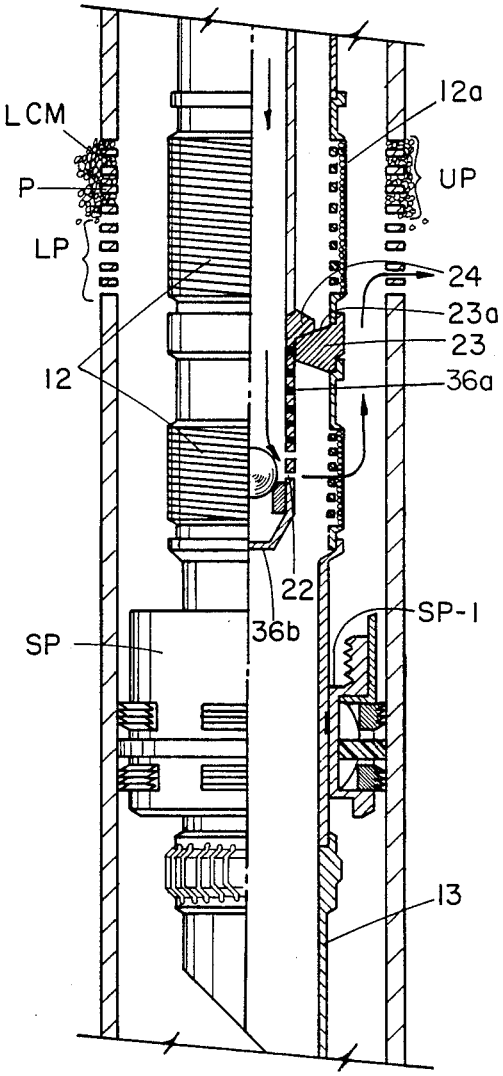

The volume of this annular area and the interior of the conduit 10 and inner mandrel 36 will be known, as well as the positions of the lowermost perforations LP relative to the uppermost end of the sump packer SP. Accordingly, the amount of fluid which is required to treat only the lowermost portions of the perforations LP may be calculated and such introduced through the conduit 10. With the annular valve at the top of the well in the closed position, such fluid may be "squeezed" upon increase of pressure into such lowermost portions of the perforations LP for removal of the lost circulation material LCM, as shown in FIGS. 4A–4B. Pressure may be increased within the conduit 10 to "squeeze" the fluid containing the lost circulation material removal fluid into the lower perforations LP, as shown in either FIGS. 4A–4B or 5A–5B. In the position shown in FIGS. 5A–5B, the port 33 is sealingly positioned within the interior of the isolator 11 to prevent fluid communication through the interior of the isolator 11 and the annular area thereabove to the top of the well. Alternatively, as shown in FIGS. 4A–4B, the annular valve at the top of the well may be left open, and the conduit 10 with the cross-over means and inner mandrel 36 positioned with the indicator 24 placed upon the uppermost face 23*a* of the seal bore receptacle 23.

After effective treatment of the lowermost portion LP of the perforations P, as described, a cross-over tool port opening ball 18*b* is placed within the interior of the conduit 10 and permitted to sealingly rest upon a companion uppermost facing seat 18 which is shearably secured to the interior of the innermost concentric member of the cross-over assembly. Upon increase of pressure to overcome the shear securement of such sleeve, the sleeve will be shifted downwardly to expose a cross-over fluid flow port 18*c* (FIG. 7A). Accordingly, fluid will not be permitted to pass interiorly through the inner mandrel 36 below the ball 18*b* and its seat 18, but such fluid will be permitted to pass inwardly through the conduit 10, outwardly of the cross-over means by means of the port 18*c*, thence through a port 17 within the tail pipe assembly 11*a* to the annular area defined below the isolator 11 by the interior of the well perforated conduit section C and the exterior of the tail pipe assembly 11*a*. The fluid will now pass downwardly until it comes into contact with that section of the perforations above the lowermost portion LP of the perforations P and identified as the uppermost portion of the perforations UP which have not been previously treated by means of the squeezing of the fluid as shown in, for example, the position of the tool in FIGS. 5A–5B. The lost circulation removal fluid will contact and enter into and throughout the various perforations and will remove such lost circulation material LCM as it is either removed through such upper perforations UP, or drops within the zone for passage through the lowermost perforations LP. The fluid flow will pass below the perforations LP, into the lowermost fluid communicating means 12*b*, thence within the interior of the inner mandrel 36 through the ports 22 and upwardly interior of the inner mandrel 36 thence through the cross-over tool and between the concentric members T-1, T-2, thereof until it passes through the upper end 33 of the concentrically disposed cross-over tool members and into the annulus 34 above the isolator 11, thence into the annular area 34 to the top of the well. The fluid can be "squeezed" into the upper perforations UP and lower perforations LP by having the tool in the position as shown in FIGS. 7A and 7B and by closing the valve at the top of the well controlling the tubing-casing annulus.

The main purpose of establishing the flow path as shown in FIGS. 7A–7B from the position shown in FIGS. 4A–4B or 5A–5B, is to permit the fluid to pass in the direction shown by the arrows in FIGS. 8A–8B, to wash out the lost circulation material after the lost circulation material removing fluid has been squeezed or injected into the perforations by means of the position of the tool. The washing position is as shown in FIGS. 7A–7B.

After the perforations are washed of the lost circulation material LCM by fluid flow in the path shown in FIGS. 7A–7B, the apparatus is moved to the position shown in FIGS. 8A–8B and the uppermost portion of the perforations UP are treated with the fluid for removal of the lost circulation material LCM. In this position, the inner mandrel 36 has been moved upwardly such that the seals 36*a* are not sealingly engaged within the receptacle 23. Accordingly, fluid now passes through the perforations P and into the uppermost of the fluid communicating members 12*a*, thence through the ports 22 at the lowermost end of the inner mandrel 36 and through the interior of the inner mandrel 36, upwardly, thence through the upper end 33 of the concentrically disposed members of the cross-over tool and into the annular area 34 for circulation to the top of the well.

After completion of the removal of the lost circulation material LCM from the uppermost portions UP of the perforations P by positioning the tool as shown in FIGS. 8A–8B, the tool is moved to the position shown in FIGS. 9A–9B by picking up completely on the conduit 10 to raise same until the port 18*c* is above the uppermost end of the isolator 11. Seals 36*b*, are still positioned within the interior of the isolator 11, thus preventing fluid from passing inwardly of the interior 11 and to the well below the isolator 11. The purpose of positioning the tool as shown in FIGS. 9A–9B in such position is to wash out the annular area of the tool above the isolator 11 to remove any of the fluid which has contained the lost circulation removal fluid.

Figure 11A:
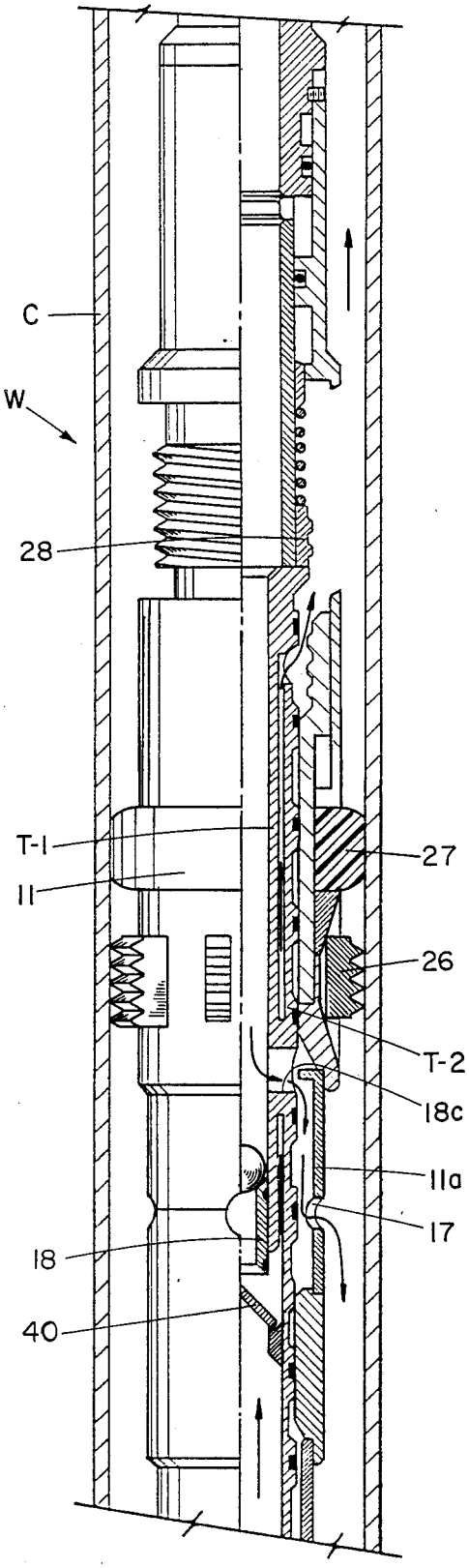
FIGS. 11A and 11B are views similar to that of FIGS. 10A and 10B showing continuation of the gravel packing procedure through passage of fluid only through the first or uppermost of the communicating members thence interior of the apparatus and to the exterior of the apparatus above the isolator means into the annular area between the casing and the well conduit concentrically disposed therein.
Figure 11B:
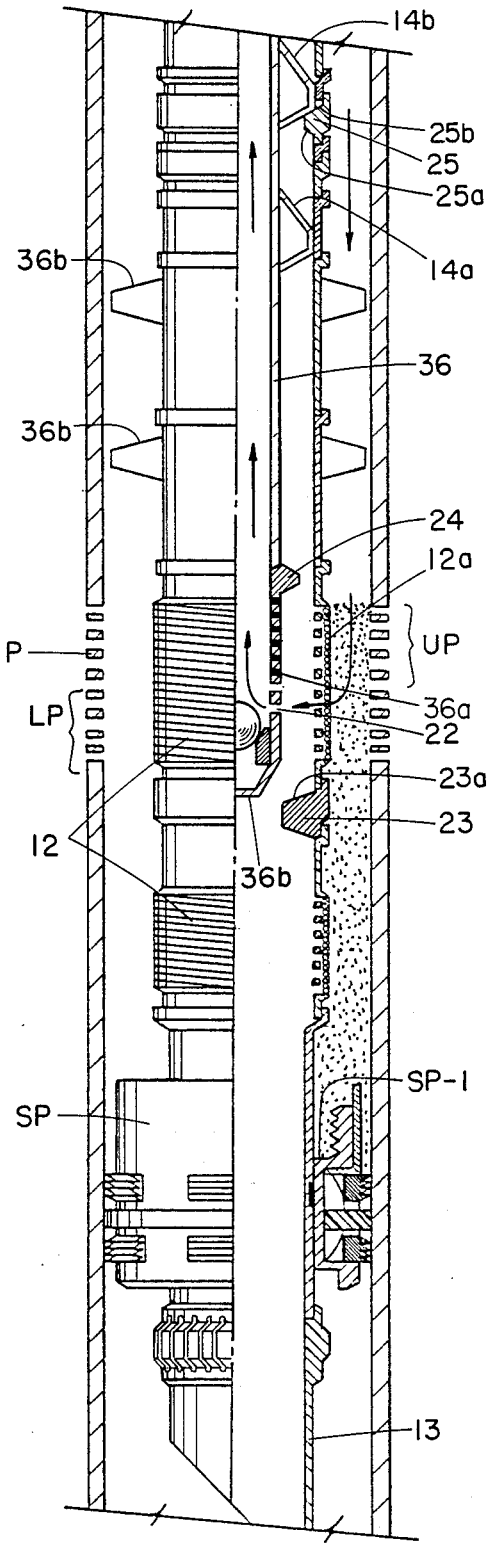

Alternatively of positioning the tool as shown in FIGS. 9A–9B, the tool may be repositioned to the position shown in FIGS. 10A–10B (which is also the same position of the tool as shown in FIGS. 7A–7B) where a gravel packing fluid and gravel are placed into the uppermost end of the conduit 10 at the top of the well and pumped through the conduit 10 for passage out of the port 18*c* in the cross-over tool and through the port 17 in the tail pipe section 11*a*, such that gravel may be deposited above the sump packer SP in the annular area defined by the interior of the casing C and the exterior of the tail pipe section 11*a* until the lower fluid communicating means 12*b* is covered with gravel. As the gravel is deposited around the exterior of the fluid communicating member 12*a*, the fluid will enter the lowermost fluid communicating member 12*b*, thence through the ports 22 and will then move upwardly within the inner mandrel 36, through the port 33 and into the annular area 34 above the isolator 11 for recirculation to the top of the well, as shown in FIGS. 7A–7B. As the telltale fluid communicating member **12*b* is covered, an increase in pressure will be noted at the top of the well. Accordingly, the conduit 10 may be picked up and moved to position to remove the seals 36*a* out of the seal receptacle 23 to the position shown in FIGS. 11A–11B (which is also the position shown in FIGS. 8A–8B). Now, the gravel packing fluid may be continued to be pumped to cover the exterior of the fluid communicating means member 12*a* and the fluid passing to the top of the well in the same fluid flow path as described in FIGS. 10A–10B and as shown in FIGS. 11A–11B. After gravel packing has been effected, the tool may then be shifted to the position shown in FIGS. 9A–9B for cleaning out of the annular area above the well isolator 11. Thereafter, or alternatively, the conduit 10 with the inner mandrel 36 carried thereon may be completely removed from the well, the well killed, and production tubing run into an stabbed into the uppermost end of the isolator 11 for subsequent production of the well through the fluid communicating means 12 and the interior of the tail pipe 11*a***.

The fluid communicating members **12*a* and 12*b*** may take a variety of forms They may be provided in the form of ported or slotted tubing members, or may be wire wrapped screen having circumferentially extending open slots therethrough, or any other readily available forms known to those skilled in the art.

While a hydraulically actuated packer is preferably utilized, it will be appreciated that mechanically actuated packers may also be utilized to perform the method of this invention. Such packers may be set and/or retrieved by mechanical action including a number of variations of tubing reciprocation, or incorporation of electrical impulse energized formats for a portion or all of the setting and/or retrieval modes.

In treating the lower perforations LP for removal of the lost circulation material LCM the fluid used to remove the material preferably is injected into the perforations until a loss of circulation is indicated by means of a substantial drop control pressure within the conduit 10. This loss of pressure will indicate that the material LCM has been effectively driven out of the lower perforations LP to the extent that the zone is taking fluid. Now, the upper perforations UP containing the lost circulation material LCM may be subjected to the fluid until the material LCM is removed therefrom, as further indicated by substantial pressure drop within the conduit 10 during this second treatment step.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A method of injection of fluid within a subterranean well for removal of lost circulation material which has been deposited within perforations through a first perforated well conduit section traversing a production zone, by first initiating removal of said material upwardly from the lowermost portion of said section and by subsequent continuation of removal of said material downwardly from the uppermost portion of said section, comprising the steps of:

(1) assembling a second conduit which carries a zone isolator and fluid communicating means comprising first and second communicating members;

(2) running the second conduit into the well until the isolator is positioned above the production zone with the first communicating member being in proximity to the uppermost end of the perforations and the second communicating member being in proximity to the lowermost end of the perforations;

(3) sealingly securing the isolator within and against the first well conduit above said zone;

(4) forming a first injection path for said fluid which extends from the top of the well, through the interior of said communicating means and out only the exterior of the second communicating member and into the lowermost of said perforations for contact with and removal of said lost circulation material therefrom until a loss of circulation of said fluid is established; and (5) forming a second injection path for said fluid which extends from the top of the well through the first communicating member of said communicating means while preventing said fluid from passing from the interior to the exterior of said second communicating member, said second injection path for said fluid continuing out of said first communicating member and into the other of said perforations for contact with and removal of the remainder of said lost circulation material.

2. The method of claim 1 wherein the fluid communicating members comprise slotted screens circumferentially extending around said second conduit, and said second conduit comprises a tubular conduit, said tubular conduit having a portion interior of said screens ported to permit fluid flow between said screen and said second tubular conduit.

3. The method of claim 1 wherein the fluid communicating members comprise wire wrapped screens circumferentially extending around said second conduit, and said second conduit comprises a tubular conduit, said tubular conduit having a portion interior of said screens ported to permit fluid flow between said screen and said tubular conduit.

4. The method of claim 1 wherein said second conduit is a tubular conduit.

5. The method of claim 1 wherein said first and second injection paths comprise sectional lengths of said conduit, and said second conduit is a tubular conduit.

6. The method of claim 1 further comprising the steps of:

with the isolator continuing to be sealingly secured within and against the first well conduit above said zone, forming a gravel pack fluid flow path which extends from the surface downhole through the interior of the isolator, around the exterior of said communicating means, and a return fluid flow path for said gravel pack fluid through the interior of said communicating means and back up hole to the top of the well.

7. The method of claim 6, further comprising the step of mixing gravel with a gravel pack fluid and flowing said gravel in said gravel pack fluid in said gravel pack fluid flow path until the gravel is deposited in said well below said isolator means and exterior of said communicating means, and returning the gravel pack fluid through the interior of the communicating means and within said return fluid flow path up hole to the top of the well.

8. The method of claim 7, further comprising the step of:

with the isolator still in sealingly engaged position, forming a production flow path from the production zone, through the perforations, through the deposited gravel, through the communicating means and uphole to the top of the well.

9. A method of injection of fluid within a subterranean well for removal of lost circulation material which has been deposited within perforations through a first perforated well conduit section traversing a production zone, by first initiating removal of said material upwardly from the lowermost portion of said section and by subsequent continuation of removal of said material downwardly from the uppermost portion of said section, comprising the steps of:

(1) assembling a second conduit which carries a fluid flow cross-over means, a zone isolator and fluid communicating means comprising first and second communicating members;

(2) running the second conduit into the well until the isolator is positioned above the production zone with the first communicating member being in proximity to the uppermost end of the perforations and the second communicating member being in proximity to the lowermost end of the perforations;

(3) hydraulically activating the isolator to sealingly secure said isolator within and against the first well conduit above said zone;

(4) manipulating said cross-over tool to one position and forming a first injection path for said fluid which extends from the top of the well, through said cross-over tool, through the interior of said communicating means and out only the exterior of the second communicating member and into the lowermost of said perforations for contact with and removal of said lost circulation material therefrom; and (5) manipulating said cross-over tool to another position and forming a second injection path for said fluid which extends from the top of the well through said cross-over tool through the first communicating member of said communicating means for preventing said fluid from passing from the interior to the exterior of said second communicating member, said second injection path for said fluid continuing out of said first communicating member and into the other of said perforations for contact with and removal of the remainder of said lost circulation material.

10. A method of injection of fluid within a subterranean well for removal of lost circulation material which has been deposited within perforations through a first perforated well conduit section traversing a production zone, by first initiating removal of said material upwardly from the lowermost portion of said section and by subsequent continuation of removal of said material downwardly from the uppermost portion of said section, comprising the steps of:

(1) assembling a second conduit which carries a zone isolator, a fluid flow cross-over tool, and fluid communicating means comprising first and second communicating members;

(2) running the second conduit into the well until the isolator is positioned above the production zone with the first communicating member being in proximity to the uppermost end of the perforations and the second communicating member being in proximity to the lowermost end of the perforations;

(3) sealingly securing the isolator within and against the first well conduit above said zone;

(4) manipulating the fluid cross-over tool to a first position to permit downward fluid flow therethrough to pass exteriorly out of said communicating means through only the second communicating member and upwardly to the top of the well above said isolator means through an annulus defined between said first well conduit and another conduit concentrically disposed therein;

(5) moving said fluid cross-over tool to a second position whereby fluid is permitted to pass through said fluid cross-over tool downwardly therethrough and exteriorly through only said second communicating member and is prevented from flowing to the annular area above said isolator means between said first well conduit and said concentrically disposed conduit therethrough, whereby fluid for removal of said lost circulation material may be squeezed into the lowermost of said perforations for removal of said lost circulation material therefrom;

(6) manipulating said fluid cross-over tool to a third position whereby fluid for removal of said lost circulation material passes through said fluid cross-over tool, thence exteriorly below said isolator means in an annular area between said first perforated well conduit and the fluid communicating means, into contact with the other of said perforations through said perforated well conduit section, thence through only the second of said first and second fluid communicating members thence through the interior of said cross-over tool and into the annular area above said isolator means between said first well conduit and the concentrically disposed conduit therethrough;

(7) manipulating said cross-over tool to another position whereby said fluid for removal of said lost circulation material passes downwardly through said cross-over tool, thence within the annular area below said isolator means between said first perforated well conduit section and said communicating means, then into contact with the perforations of the first perforated well conduit section and into at least one of the first and second communicating members, through the interior of the cross-over tool, thence outwardly above said isolator means through the annular area between said first well conduit member and the concentric member positioned therethrough to the top of the well; and (8) preventing continued flow above said isolator means within said annular area between said first well conduit member and the concentric member disposed therethrough by manipulating valve means in communication with said annular area above said isolator means between said first well conduit and the concentric tubular member positioned therethrough to closed position whereby said fluid for removal of lost circulation material may be squeezed into said perforations through said first perforated well conduit section.

11. A method of injection of fluid within a subterranean well for removal of lost circulation material which has been deposited within perforations through a first perforated well conduit section traversing a production zone, by first initiating removal of said material upwardly from the lowermost portion of said section and by subsequent continuation of removal of said material downwardly from the uppermost portion of said section, comprising the steps of:

(1) assembling a second conduit which carries a zone isolator, a fluid flow cross-over tool, and fluid communicating means comprising first and second communicating members;

(2) running the second conduit into the well until the isolator is positioned above the production zone with the first communicating member being in proximity to the uppermost end of the perforations and the second communicating member being in proximity to the lowermost end of the perforations;

(3) sealingly securing the isolator within and against the first well conduit above said zone;

(4) manipulating the fluid cross-over tool to a first position to permit downward fluid flow therethrough to pass exteriorly out of said communicating means through only the second communicating member and upwardly to the top of the well above said isolator means through an annulus defined between said first well conduit and another conduit concentrically disposed therein;

(5) moving said fluid cross-over tool to a second position whereby fluid is permitted to pass through said fluid cross-over tool downwardly therethrough and exteriorly through only said second communicating member and is prevented from flowing to the annular area above said isolator means between said first well conduit and said concentrically disposed conduit therethrough, whereby fluid for removal of said lost circulation material may be squeezed into the lowermost of said perforations for removal of said lost circulation material therefrom;

(6) manipulating said fluid cross-over tool to a third position whereby fluid for removal of said lost circulation material passes through said fluid cross-over tool, thence exteriorly below said isolator means in an annular area between said first perforated well conduit and the fluid communicating means, into contact with the other of said perforations through said perforated well conduit section, thence through only the second of said first and second fluid communicating members thence through the interior of said cross-over tool and into the annular area above said isolator means between said first well conduit and the concentrically disposed conduit therethrough;

(7) manipulating said cross-over tool to another position whereby said fluid for removal of said lost circulation material passes downwardly through said cross-over tool, thence within the annular area below said isolator means between said first perforated well conduit section and said communicating means, then into contact with the perforations of the first perforated well conduit section and into at least one of the first and second communicating members, through the interior of the cross-over tool, thence outwardly above said isolator means through the annular area between said first well conduit member and the concentric member positioned therethrough to the top of the well;

(8) preventing continued flow above said isolator means within said annular area between said first well conduit member and the concentric member disposed therethrough by manipulating valve means in communication with said annular area above said isolator means between said first well conduit and the concentric tubular member positioned therethrough to closed position whereby said fluid for removal of lost circulation material may be squeezed into said perforations through said first perforated well conduit section; and (9) manipulating said cross-over tool to a position and introducing fluid containing gravel through said cross-over tool means for deposition of said gravel exterior of said communicating means and for flow of fluid without said gravel interiorly of said cross-over tool means thence exteriorly of said cross-over tool means above said isolator means in the annular area between the first well conduit and the concentrically disposed conduit therethrough, while said isolator means still remains in sealing securement against the first well conduit above said zone.

12. A method of injection of fluid within a subterranean well for removal of lost circulation material which has been deposited within perforations through a first perforated well conduit section traversing a production zone, by first initiating removal of said material upwardly from the lowermost portion of said section and by subsequent continuation of removal of said material downwardly from the uppermost portion of said section, comprising the steps of:

(1) assembling a second conduit which carries a zone isolator, a fluid flow cross-over tool, and fluid communicating means comprising first and second communicating members;

(2) running the second conduit into the well until the isolator is positioned above the production zone with the first communicating member in proximity to the uppermost end of the perforations and the second communicating member being in proximity to the lowermost end of the perforations;

(3) sealingly securing the isolator within and against the first well conduit above said zone;

(4) manipulating the fluid cross-over tool to a first position to permit downward fluid flow therethrough to pass exteriorly out of said communicating means through only the second communicating member and upwardly to the top of the well above said isolator means through an annulus defined between said first well conduit and another conduit concentrically disposed therein;

(5) moving said fluid cross-over tool to a second position whereby fluid is permitted to pass through said fluid cross-over tool downwardly therethrough and exteriorly through only said second communicating member and is prevented from flowing to the annular area above said isolator means between said first well conduit and said concentrically disposed conduit therethrough, whereby fluid for removal of said lost circulation material may be squeezed into the lowermost of said perforations for removal of said lost circulation material therefrom;

(6) manipulating said fluid cross-over tool to a third position whereby fluid for removal of said lost circulation material passes through said fluid cross-over tool, thence exteriorly below said isolator means in an annular area between said first perforated well conduit and the fluid communicating means, into contact with the other of said perforations through said perforated well conduit section, thence through only the second of said first and second fluid communicating members thence through the interior of said cross-over tool and into the annular area above said isolator means between said first well conduit and the concentrically disposed conduit therethrough;

(7) manipulating said cross-over tool to another position whereby said fluid for removal of said lost circulation material passes downwardly through said cross-over tool, thence within the annular area below said isolator means between said first perforated well conduit section and said communicating means, then into contact with the perforations of the first perforated well conduit section and into at least one of the first and second communicating members, through the interior of the cross-over tool, thence outwardly above said isolator means through the annular area between said first well conduit member and the concentric member positioned therethrough to the top of the well;

(8) preventing continued flow above said isolator means within said annular area between said first well conduit member and the concentric member disposed therethrough by manipulating valve means in communication with said annular area above said isolator means between said first well conduit and the concentric tubular member positioned therethrough to closed position whereby said fluid for removal of lost circulation material may be squeezed into said perforations through said first perforated well conduit section;

(9) manipulating said cross-over tool to a position and introducing fluid containing gravel through said cross-over tool means for deposition of said gravel exterior of said communicating means and for flow of fluid without said gravel interiorly of said cross-over tool means thence exteriorly of said cross-over tool means above said isolator means in the annular area between the first well conduit and the concentrically disposed conduit therethrough, while said isolator means still remains in sealing securement against the first well conduit above said zone; and

(10) manipulating said cross-over tool to squeeze said gravel into place in said well adjacent said perforations and exterior of said communicating means.

13. A method of injection of fluid within a subterranean well for removal of lost circulation material which has been deposited within perforations through a first perforated well conduit section traversing a production zone, by first initiating removal of said material upwardly from the lowermost portion of said section and by subsequent continuation of removal of said material downwardly from the uppermost portion of said section, comprising the steps of:

(1) assembling a second conduit which carries a zone isolator, a fluid flow cross-over tool, and fluid communicating means comprising first and second communicating members;

(2) running the second conduit into the well until the isolator is positioned above the production zone with the first communicating member in proximity to the uppermost end of the perforations and the second communicating member being in proximity to the lowermost end of the perforations;

(3) sealingly securing the isolator within and against the first well conduit above said zone;

(4) manipulating the fluid cross-over tool to a first position to permit downward fluid flow therethrough to pass exteriorly out of said communicating means through only the second communicating member and upwardly to the top of the well above said isolator means through an annulus defined between said first well conduit and another conduit concentrically disposed therein;

(5) moving said fluid cross-over tool to a second position whereby fluid is permitted to pass through said fluid cross-over tool downwardly therethrough and exteriorly through only said second communicating member and is prevented from flowing to the annular area above said isolator means between said first well conduit and said concentrically disposed conduit therethrough, whereby fluid for removal of said lost circulation material may be squeezed into the lowermost of said perforations for removal of said lost circulation material therefrom;

(6) manipulating said fluid cross-over tool to a third position whereby fluid for removal of said lost circulation material passes through said fluid cross-over tool, thence exteriorly below said isolator means in an annular area between said first perforated well conduit and the fluid communicating means, into contact with the other of said perforations through said perforated well conduit section, thence through only the second of said first and second fluid communicating members thence through the interior of said cross-over tool and into the annular area above said isolator means between said first well conduit and the concentrically disposed conduit therethrough;

(7) manipulating said cross-over tool to another position whereby said fluid for removal of said lost circulation material passes downwardly through said cross-over tool, thence within the annular area below said isolator means between said first perforated well conduit section and said communicating means, then into contact with the perforations of the first perforated well conduit section and into at least one of the first and second communicating members, through the interior of the cross-over tool, thence outwardly above said isolator means through the annular area between said first well conduit member and the concentric member positioned therethrough to the top of the well;

(8) preventing continued flow above said isolator means within said annular area between said first well conduit member and the concentric member disposed therethrough by manipulating valve means in communication with said annular area above said isolator means between said first well conduit and the concentric tubular member positioned therethrough to closed position whereby said fluid for removal of lost circulation material may be squeezed into said perforations through said first perforated well conduit section; and (9) forming a production flow path from the production zone, through the perforations, through the communicating means and uphole of the top of the well, while the isolator means still is in sealing securement against the first well conduit.

14. A method of injection of fluid within a subterranean well for removal of lost circulation material which has been deposited within perforations through a first perforated well conduit section traversing a production zone, by first initiating removal of said material upwardly from the lowermost portion of said section and by subsequent continuation of removal of said material downwardly from the uppermost portion of said section, comprising the steps of:

(1) assembling a second conduit which carries a zone isolator, a fluid flow cross-over tool, and fluid communicating means comprising first and second communicating members;

(2) running the second conduit into the well until the isolator is positioned above the production zone with the first communicating member in proximity to the uppermost end of the perforations and the second communicating member being in proximity to the lowermost end of the perforations;

(3) sealingly securing the isolator within and against the first well conduit above said zone;

(4) manipulating the fluid cross-over tool to a first position to permit downward fluid flow therethrough to pass exteriorly of said communicating means through only the second communicating member and upwardly to the top of the well above said isolator means through an annulus defined between said first well conduit and another conduit concentrically disposed therein;

(5) moving said fluid cross-over tool to a second position whereby fluid is permitted to pass through said fluid cross-over tool downwardly therethrough and exteriorly through only said second communicating member and is prevented from flowing to the annular area above said isolator means between said first well conduit and said concentrically disposed conduit therethrough, whereby fluid for removal of said lost circulation material may be squeezed into the lowermost of said perforations for removal of said lost circulation material therefrom;

(6) manipulating said fluid cross-over tool to a third position whereby fluid for removal of said lost circulation material passes through said fluid cross-over tool, thence exteriorly below said isolator means in an annular area between said first perforated well conduit and the fluid communicating means, into contact with the other of said perforations through said perforated well conduit section, thence through only the second of said first and second fluid communicating members thence through the interior of said cross-over tool and into the annular area above said isolator means between said first well conduit and the concentrically disposed conduit therethrough;

(7) manipulating said cross-over tool to another position whereby said fluid for removal of said lost circulation material passes downwardly through said cross-over tool, thence within the annular area below said isolator means between said first perforated well conduit section and said communicating means, then into contact with the perforations of the first perforated well conduit section and into at least one of the first and second communicating members, through the interior of the cross-over tool, thence outwardly above said isolator means through the annular area between said first well conduit member and the concentric member positioned therethrough to the top of the well;

(8) preventing continued flow above said isolator means within said annular area between said first well conduit member and the concentric member disposed therethrough by manipulating valve means in communication with said annular area above said isolator means between said first well conduit and the concentric tubular member positioned therethrough to closed position whereby said fluid for removal of lost circulation material may be squeezed into said perforations through said first perforated well conduit section;

(9) manipulating said cross-over tool to a position and introducing fluid containing gravel through said cross-over tool means for deposition of said gravel exterior of said communicating means and for flow of fluid without said gravel interiorly of said cross-over tool means thence exteriorly of said cross-over tool means above said isolator means in the annular area between the first well conduit and the concentrically disposed conduit therethrough, while said isolator means still remains in sealing securement against the first well conduit above said zone; and

(10) forming a production flow path from the production zone through the perforations, through the deposited gravel, through the communicating means and uphold to the top of the well while the isolator still is in sealing securement position within and against the first well conduit above said zone.

15. An apparatus for injection of fluid within a subterranean well for removal of lost circulation material which has been deposited within perforations through a first perforated well conduit section traversing a production zone by first initiating removal of said material upwardly from the lowermost portion of said section and by subsequent continuation of removal of said material downwardly from the uppermost portion of said section, comprising:

(1) a second conduit which carries a zone isolator and fluid communicating means comprising first and second communicating members;

(2) means for running the second conduit into the well until the isolator is positioned above the production zone with the first communicating member in proximity to the uppermost end of the perforations and the second communicating member being in proximity to the lowermost end of the perforations;

(3) means for sealingly securing the isolator within and against the first well conduit above said zone;

(4) means for forming a first injection path for said fluid which extends from the top of the well, through the interior of said communicating means and out only the exterior of the second communicating member and into the lowermost of said perforations for contact with and removal of said lost circulation material therefrom; and (5) means for forming a second injection path for said fluid which extends from the top of the well through the first communicating member of said communicating means while preventing said fluid from passing from the interior to the exterior of said second communicating member, said second injection path for said fluid continuing out of said first communicating member and into the other of said perforations for contact with and removal of the remainder of said lost circulation material therefrom.

16. The apparatus of claim 15 wherein the fluid communicating members comprise slotted screens circumferentially extending around said conduit, and said conduit comprises a tubular conduit, said tubular conduit having a portion interior of said screens ported to permit fluid flow between said screen and said tubular conduit.

17. The apparatus of claim 15 wherein the fluid communicating members comprise wire wrapped screens circumferentially extending around said conduit, and said conduit comprises a tubular conduit, said tubular conduit having a portion interior of said screens ported to permit fluid flow between said screen and said tubular conduit.

18. The apparatus of claim 15 wherein said conduit is a tubular conduit.

19. The apparatus of claim 15 wherein said first and second injection paths comprise sectional lengths of said conduit, and said conduit is a tubular conduit.

20. The apparatus of claim 15 further comprising:

with the isolator continuing to be sealingly secured within and against the first well conduit above said zone, means for forming a gravel pack fluid flow path which extends from the surface downhole through the interior of the isolator, around the exterior of said communicating means, and return fluid flow path for said gravel pack fluid through the interior of said communicating means and back up hole to the top of the well.

21. A method of injection of fluid within a subterranean well for removal of lost circulation material which has been deposited across a formation section of a production zone within said well, by first initiating removal of said material upwardly from the lowermost portion of said section and by subsequent continuation of removal of said material downwardly from the uppermost portion of said section, comprising the steps of:

(1) assembling a conduit which carries a zone isolator and fluid communicating means comprising first and second communicating members;

(2) running the conduit into the well until the isolator is positioned above the production zone with the first communicating member being in proximity to the uppermost end of the production zone and the second communicating member being in proximity to the lowermost end of the production zone;

(3) sealingly securing the isolator within and against the wellbore above said production zone;

(4) forming a first injection path for said fluid which extends from the top of the well, through the interior of said communicating means and out only the exterior of the second communicating member and into the lowermost portion of said production zone for contact with and removal of said lost circulation material therefrom until a loss of circulation of said fluid is established; and (5) forming a second injection path for said fluid which extends from the top of the well through the first communicating member of said communicating means while preventing said fluid from passing from the interior to the exterior of said second communicating member, said second injection path for said fluid continuing out of said first communicating member and into the other portion of said production zone for contact with and removal of the remainder of said lost circulation material.

22. The method of claim 21 wherein the fluid communicating members comprise slotted screens circumferentially extending around said conduit, and said conduit comprises a tubular conduit, said tubular conduit having a portion interior of said screens ported to permit fluid flow between said screen and said tubular conduit.

23. The method of claim 21 wherein the fluid communicating members comprise wire wrapped screens circumferentially extending around said conduit, and said conduit comprises a tubular conduit, said tubular conduit having a portion interior of said screens ported to permit fluid flow between said screen and said tubular conduit.

24. The method of claim 21 wherein said conduit is a tubular conduit.

25. The method of claim 21 wherein said first and second injection paths comprise sectional lengths of said conduit and said conduit is a tubular conduit.

26. The method of claim 21 further comprising the steps of:

for the isolator continuing to be sealingly secured within and against the wall of said well adjacent said production zone, forming a gravel pack fluid flow path which extends from the surface downhole through the interior of the isolator, around the exterior of said communicating means, and a return fluid flow path for said gravel pack fluid through the interior of said communicating means and back uphole to the top of the well.

27. The method of claim 26 further comprising the step of mixing gravel with a gravel pack fluid and flowing said gravel in said gravel pack fluid in said gravel pack fluid flow path until the gravel is deposited in said well below said isolator means and exterior of said communicating means, and returning the gravel pack fluid through the interior of the communicating means and within said return fluid flow path uphole to the top of the well.

28. The method of claim 27, further comprising the step of:

with the isolator still in sealingly engaged position, forming a production flow path from the production zone, through the deposited gravel, through the communicating means and uphole to the top of the well.

* * * * *